US009767950B2

(12) United States Patent
Kim et al.

(10) Patent No.: US 9,767,950 B2
(45) Date of Patent: Sep. 19, 2017

(54) MULTILAYER ELECTRONIC COMPONENT

(71) Applicant: SAMSUNG ELECTRO-MECHANICS CO., LTD., Suwon (KR)

(72) Inventors: Myeong Gi Kim, Suwon (KR); Il Jin Park, Suwon (KR); Ho Yoon Kim, Suwon (KR); Jin Woo Hahn, Suwon (KR); Min Kyoung Cheon, Suwon (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 118 days.

(21) Appl. No.: 14/281,097

(22) Filed: May 19, 2014

(65) Prior Publication Data

US 2015/0102888 A1 Apr. 16, 2015

(30) Foreign Application Priority Data

Oct. 14, 2013 (KR) ..... 10-2013-0121983

(51) Int. Cl.
*H01F 5/00* (2006.01)
*H01F 27/28* (2006.01)
*H01F 17/00* (2006.01)

(52) U.S. Cl.
CPC ..... *H01F 17/0013* (2013.01)

(58) Field of Classification Search
CPC ..... H01F 5/00; H01F 27/28
(Continued)

(56) References Cited

U.S. PATENT DOCUMENTS 6,762,925 B2 * 7/2004 Uchida ..... H03H 7/0115 29/25.41
9,349,517 B2 5/2016 Matsuura et al.
(Continued)

FOREIGN PATENT DOCUMENTS

CN 102610362 A 7/2012
CN 102893346 A 1/2013
(Continued)

OTHER PUBLICATIONS

Japanese Office Action dated Feb. 7, 2017, issued in Japanese patent application No. 2014-104972. (w/ English translation).

*Primary Examiner* — Tsz Chan
(74) *Attorney, Agent, or Firm* — McDermott Will & Emery LLP

(57) ABSTRACT

A multilayer electronic component may include: a magnetic body in which a plurality of magnetic layers are stacked; and conductor patterns formed on the magnetic body. The magnetic body may include: metal magnetic particles; an oxide film formed on a surface of the metal magnetic particle as a first oxide obtained by oxidation of at least one component of the metal magnetic particle; and a filling portion formed in a space between the metal magnetic particles as a second oxide obtained by oxidization of at least one component of the metal magnetic particle. At least one of the first oxide and the second oxide is provided between adjacent metal magnetic particles, and an oxide film formed on a surface of a metal magnetic particle forms a neck portion with an oxide film formed on a surface of an adjacent metal magnetic particle.

26 Claims, 6 Drawing Sheets

(58) Field of Classification Search
USPC ..... 336/200, 232
See application file for complete search history.

(56) References Cited

U.S. PATENT DOCUMENTS

| | | | | |
|---|---|---|---|---|
| 2009/0174512 | A1 | 7/2009 | Watanabe et al. | |
| 2010/0253463 | A1* | 10/2010 | Shimomura | H01F 17/04 336/200 |
| 2010/0289609 | A1* | 11/2010 | Liao | H01F 17/04 336/221 |
| 2011/0247930 | A1* | 10/2011 | Sato | C22C 32/0026 204/298.13 |
| 2011/0267167 | A1 | 11/2011 | Ogawa et al. | |
| 2011/0272622 | A1 | 11/2011 | Wakabayashi et al. | |
| 2012/0038449 | A1* | 2/2012 | Ogawa | H01F 1/33 336/221 |
| 2012/0188046 | A1* | 7/2012 | Matsuura | H01F 17/0033 336/199 |
| 2012/0188049 | A1* | 7/2012 | Matsuura | B22F 1/02 336/212 |
| 2012/0274438 | A1* | 11/2012 | Hachiya | H01F 17/0013 336/221 |
| 2013/0120097 | A1* | 5/2013 | Hachiya | H01F 1/40 336/200 |
| 2013/0127576 | A1 | 5/2013 | Hachiya et al. | |
| 2013/0154784 | A1 | 6/2013 | Hachiya et al. | |
| 2013/0200970 | A1 | 8/2013 | Ogawa et al. | |
| 2013/0228716 | A1 | 9/2013 | Suetsuna et al. | |

FOREIGN PATENT DOCUMENTS

| | | | | |
|---|---|---|---|---|
| JP | 04-226003 | A | | 8/1992 |
| JP | 2006-233325 | A | | 9/2006 |
| JP | 2007-27354 | | | 2/2007 |
| JP | 2007123703 | A | * | 5/2007 |
| JP | 2008028162 | A | * | 2/2008 |
| JP | 2008091414 | A | * | 4/2008 |
| JP | 2008-244347 | A | | 10/2008 |
| JP | 2009-246256 | A | | 10/2009 |
| JP | 2011-249774 | A | | 12/2011 |
| JP | 2012-164959 | A | | 8/2012 |
| JP | 2012-238840 | | | 12/2012 |
| JP | 2013-008762 | A | | 1/2013 |
| JP | 2013-65844 | | | 4/2013 |
| JP | 2013-098210 | A | | 5/2013 |
| JP | 2013-110171 | | | 6/2013 |
| JP | 2013-125887 | A | | 6/2013 |
| WO | 2010/082486 | A1 | | 7/2010 |

* cited by examiner

"B"

MULTILAYER ELECTRONIC COMPONENT

CROSS-REFERENCE TO RELATED APPLICATIONS

This application claims the benefit of Korean Patent Application No. 10-2013-0121983 filed on Oct. 14, 2013, with the Korean Intellectual Property Office, the disclosure of which is incorporated herein by reference.

BACKGROUND

The present disclosure relates to a multilayer electronic component, and more specifically, to a compact multilayer electronic component having excellent magnetic properties, capable of being mass-produced.

Among electronic components, an inductor, an important passive element constituting an electronic circuit together with a resistor and a capacitor, is used to remove noise or to constitute an LC resonance circuit. Various types of inductor exist, such as a multilayer type inductor, a wire-wound type inductor, a thin film type inductor, or the like, according to a structure thereof.

Recent electronic devices are required to be relatively small in terms of size. However, in general DC-DC converters, due to an increase in components such as inductors, condensers, and the like, an area of power circuit may be increased.

Therefore, in order to achieve miniaturization of electronic devices, first, components are required to be relatively small. In the case in which a switching frequency of a DC-DC converter is high, the number of inductors or condensers required may be reduced, and miniaturization of the components may be facilitated. Recently, in accordance with the implementation of highly functional integrated Circuits (IC), according to advances in semiconductor manufacturing technology, efforts to increase the magnitude of switching frequencies have been undertaken.

As part of this trend, a wire-wound type inductor having lead wires wound around metal-based magnetic materials has largely been used as a power inductor in a DC-DC converter circuit according to the related art. However, the inductor has a fundamental limitation in miniaturization. Therefore, in recent years, multilayer inductors have increasingly been used in the place of wire-wound type inductors.

Meanwhile, multilayer inductors have disadvantages in that changes in inductance values according to the application of currents may be relatively large, as compared to the wire-wound type power inductors.

In multilayer inductors, magnetic layers and conductor patterns are alternately stacked, the conductor patterns being electrically connected between the magnetic layers, thereby forming coil conductors. Since ferrite-based oxides, mainly used as magnetic materials of multilayer inductors have high degrees of permeability and electrical resistance, but relatively low magnetic saturation density, there are disadvantages in that deteriorations in inductance due to magnetic saturation may be relatively large and DC bias characteristics may be poor.

That is, when DC power is applied to a multilayer inductor having the above-described configuration, magnetic saturation is generated in a magnetic body due to an increase in current, such that inductance properties may be rapidly deteriorated.

Due to the above-described reason, in the case of a multilayer power inductor using ferrite as a magnetic material according to the related art, there is a problem in that a separate non-magnetic layer should be interposed between layers to form a separation distance therebetween in order to secure DC bias characteristics.

In addition, in inductors using ferrite, circuits should be installed on a ferrite plate and a sintering process should subsequently be performed thereon. Due to a distortion phenomenon occurring during the sintering process, there is a limitation in securing a predetermined amount or more of inductance or DC bias characteristics, whereby it is difficult to increase an area of the ferrite plate. In particular, in accordance with the recent trend for inductors to be miniaturized and products having a thickness of 1 mm or less to be manufactured, the area is inevitably further limited. Therefore, it is difficult to provide various forms of inductance and DC bias characteristics.

In order to solve this problem, a magnetic metal material having a high magnetic saturation value, instead of using a ferrite magnetic material having a low magnetic saturation value, has been applied to multilayer electronic components. However, in a process of manufacturing a multilayer electronic component, a high-temperature sintering process is required in order to sinter conductor patterns formed in a magnetic body, unlike a process of manufacturing a thin film inductor. Such a high-temperature sintering process may cause the metal magnetic material to be rapidly oxidized and lose magnetic properties, and thus, the magnetic body using the metal magnetic material could not be applied to the multilayer electronic component according to the related art.

Japanese Patent Laid-Open Publication No. JP 2007-027354 discloses a method of manufacturing a magnetic material in a multilayer electronic component, in which magnetic layers formed of magnetic paste containing a glass component in addition to alloys and conductor patterns are stacked and sintered under nitrogen atmosphere at a high temperature, and then the sintered product is impregnated with a thermosetting resin.

However, since the description of Japanese Patent Laid-Open Publication No. JP 2007-027354 includes a composite of metals and resin in order to secure insulation properties, sufficient permeability may not be obtained, and in order to maintain the resin therein, a relatively low-temperature heat treatment should be performed thereon, such that internal electrodes are not densified.

SUMMARY

Additional aspects and/or advantages will be set forth in part in the description which follows and, in part, will be apparent from the description, or may be learned by practice of the invention.

An aspect of the present disclosure may provide a multilayer electronic component capable of providing excellent magnetic properties, maintaining high inductance even at high current, and having excellent DC bias characteristics, while being manufactured to have a reduced thickness and a small size in a multilayer type form.

According to an aspect, a multilayer electronic component may include: a magnetic body in which a plurality of magnetic layers are stacked; and conductor patterns formed on the magnetic body, wherein the magnetic body includes metal magnetic particles; an oxide film formed on a surface of the metal magnetic particle as a first oxide obtained by oxidation of at least one component of the metal magnetic particle; and a filling portion formed in a space between the metal magnetic particles as a second oxide obtained by oxidization of at least one component of the metal magnetic particle; at least one of the first oxide and the second oxide may be provided between adjacent metal magnetic particles, and an oxide film formed on a surface of a metal magnetic particle may form a neck portion with an oxide film formed on a surface of an adjacent metal magnetic particle.

The metal magnetic particles may be isolated from each other.

The metal magnetic particles may include an alloy containing at least one selected from a group consisting of Fe, Si, Cr, Al and Ni.

The metal magnetic particles may include a Fe—Si—Cr-based alloy.

The Fe—Si—Cr-based alloy may contain about 87 wt % or more of Fe, about 4 wt % to about 6 wt % of Cr, and a remainder of Si.

The metal magnetic particles may have a particle size of about 45 μm or less.

The metal magnetic particles may include first metal magnetic particles having a particle size distribution D50 of about 10 μm to about 20 μm, and second metal magnetic particles having a particle size distribution D50 of about 1 μm to about 5 μm.

The first oxide and the second oxide may include the same metal.

The first oxide and the second oxide may include Cr2O3.

The oxide film formed as the first oxide may have a thickness of about 50 nm to about 100 nm.

The first and second oxides may occupy about 20% to about 35% of a cross-sectional area of the magnetic body.

A decrease in a quality factor at an alternating current (AC) of about 80 mA or more may be in a range of about 10% or less.

According to an aspect, a multilayer electronic component may include: a magnetic body in which a plurality of magnetic layers are stacked; and conductor patterns formed in the magnetic body, wherein the magnetic body may include metal magnetic particles, an oxide formed by oxidization of at least one component of the metal magnetic particle may be provided between the metal magnetic particles, and the oxide may have a gradient in which a content of at least one component of the metal magnetic particle becomes reduced in a direction away from a central portion of the metal magnetic particle.

The metal magnetic particles may be isolated from each other.

The metal magnetic particles may include a Fe—Si—Cr-based alloy.

The Fe—Si—Cr-based alloy may contain about 87 wt % or more of Fe, about 4 wt % to about 6 wt % of Cr, and a remainder of Si.

The metal magnetic particles may have a particle size of about 45 μm or less.

The oxides may include Cr2O3.

An oxide film may be formed on a surface of the metal magnetic particle and the oxide film may include an oxide of at least one component of the metal magnetic particle.

The oxide film formed on the surface of the metal magnetic particle may form a neck portion with an oxide film of an adjacent metal magnetic particle.

The oxide may occupy about 20% to about 35% of a cross-sectional area of the magnetic body.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION

Figure 1:
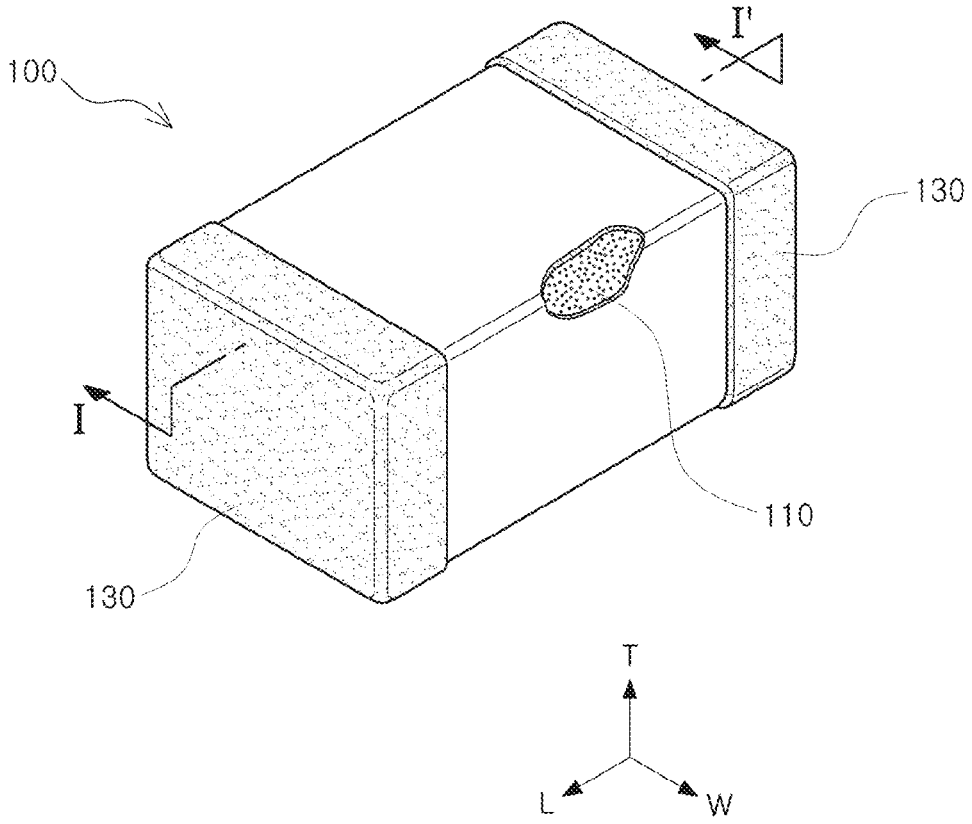
FIG. 1 is a perspective view of a multilayer inductor according to an embodiment.

Embodiments of the present disclosure will now be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Multilayer Electronic Component

Figure 2:
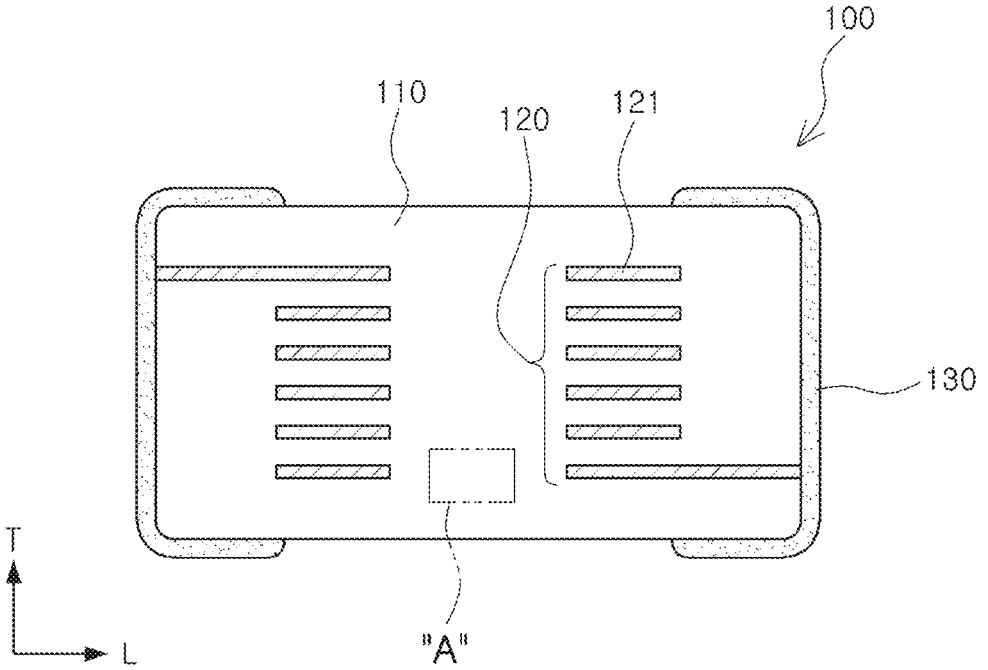
FIG. 2 is a cross-sectional view taken along line I-I' of FIG. 1.

FIG. 1 is a perspective view showing a multilayer inductor according to an embodiment, and FIG. 2 is a cross-sectional view taken along line I-I' of FIG. 1.

As shown in FIGS. 1 and 2, a multilayer inductor 100 according to an embodiment may include: a magnetic body 110 in which a plurality of magnetic layers are stacked, a coil part 120 formed by a combination of conductor patterns 121 within the magnetic body 110, and external electrodes 130 formed on both end surfaces of the magnetic body 110 to be electrically connected to both ends of the coil part 120.

Directions of the magnetic body 110 will be defined in order to clearly describe exemplary embodiments. L, W and T shown in FIG. 1 refer to a length direction, a width direction, and a thickness direction, respectively. Here, the thickness direction may be the same as a direction in which the magnetic layers are stacked.

Figure 3:
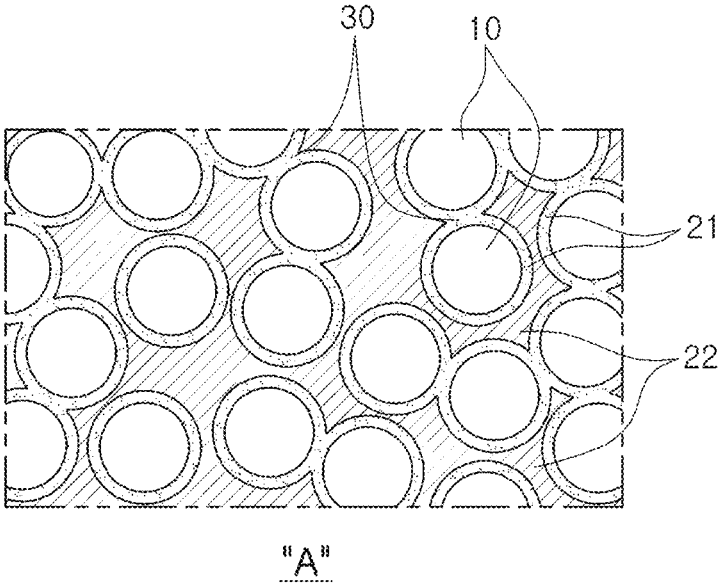
FIG. 3 is an enlarged view of an example of part A of FIG. 2.

FIG. 3 is a cross-sectional view showing an example of a fine structure configuring part "A" of the magnetic body 110 of FIG. 2.

The magnetic body 110 according to the embodiment may contain metal magnetic particles 10. An oxide film 21 may be formed on a surface of the metal magnetic particle 10 as a first oxide obtained by oxidization of at least one component of the metal magnetic particle. A filling portion 22 may be formed in a space between the metal magnetic particles 10 having the oxide film 21 formed thereon, as a second oxide obtained by oxidization of at least one component of the metal magnetic particle 10.

At least any one of the first oxide and the second oxide may be provided between the adjacent metal magnetic particles 10. Since at least any one of the first oxide and the second oxide may be provided between the adjacent metal magnetic particles 10, the adjacent metal magnetic particles may be isolated from each other without a necking phenomenon. Meanwhile, the oxide film 21 formed on the surface of the metal magnetic particle 10 may form a neck portion 30 with the oxide film of its adjacent metal magnetic particle.

The necking phenomenon between metal magnetic particles may cause an increase in eddy current loss, resulting in a decrease in a quality factor. In addition, an increase in a contact surface between the metal particles may cause an increase in AC, resulting in a significant decrease in a quality factor. However, since the neck portion is only formed between the oxide films 21 of the metal magnetic particles 10, eddy current loss may be reduced. Since there is no direct contact surface between the metal magnetic particles 10, a decrease in a quality factor due to an increase in AC may not be significant. Whereby in a case in which such a configuration of the metal magnetic particles 10 is applied to a power inductor, high power efficiency may be provided.

The metal magnetic particle 10 may be formed of a specific soft magnetic alloy, specifically, may be an alloy containing at least any one selected from a group consisting of Fe, Si, Cr, Al and Ni. For example, the metal magnetic particle 10 may be a Fe—Si—Cr-based alloy.

As an example, a Fe—Si—Cr-based alloy containing about 87 wt % or more of Fe, about 4 wt % to about 6 wt % of Cr, and a remainder of Si may be used.

In the case of using the Fe—Si—Cr-based alloy, when Fe is contained in a content less than about 87 wt %, magnetic properties may largely deteriorate.

In addition, in the case in which Cr is contained in a content of about 4 wt % to about 6 wt %, oxidation of Fe at a high sintering temperature may be prevented. Meanwhile, in the case in which Cr is contained in a content less than about 4 wt %, oxidation of Fe at a high sintering temperature may not be prevented in a process of manufacturing a multilayer inductor, resulting in a loss of magnetic properties. In the case in which Cr is contained in a content more than about 6 wt %, an excessive amount of Cr oxide may be produced, whereby a gap effect may be excessively increased, resulting in deterioration in magnetic properties (See Table 1).

According to an embodiment, the metal magnetic particle 10 may have a particle size of about 45 μm or less. A size distribution of the metal magnetic particles 10 is a very important factor for determining magnetic properties. When the size of the particles is increased, a filling ratio may be increased to increase permeability, but core loss at high frequency may be significantly increased to largely decrease a quality factor (See Table 2). Therefore, in order to show high efficiency at high frequency and have a small size, the maximum particle size of the metal magnetic particle 10 may be about 45 μm or less, and a particle size distribution $D_{50}$ thereof may be about 20 μm or less.

In defining a particle size distribution $D_{50}$ when an area per single visual field of a photograph captured with a scanning electron microscope (SEM) at a magnification of 30,000 times (30,000×) is 12.5 $\mu m^2$, particle sizes of the metal magnetic particles corresponding to 50 visual fields are calculated and listed in a descending order, and then a particle size at which the total of respective particle sizes corresponds to 50% of the overall visual field is defined as a particle size distribution $D_{50}$ at the corresponding visual field.

Figure 4:
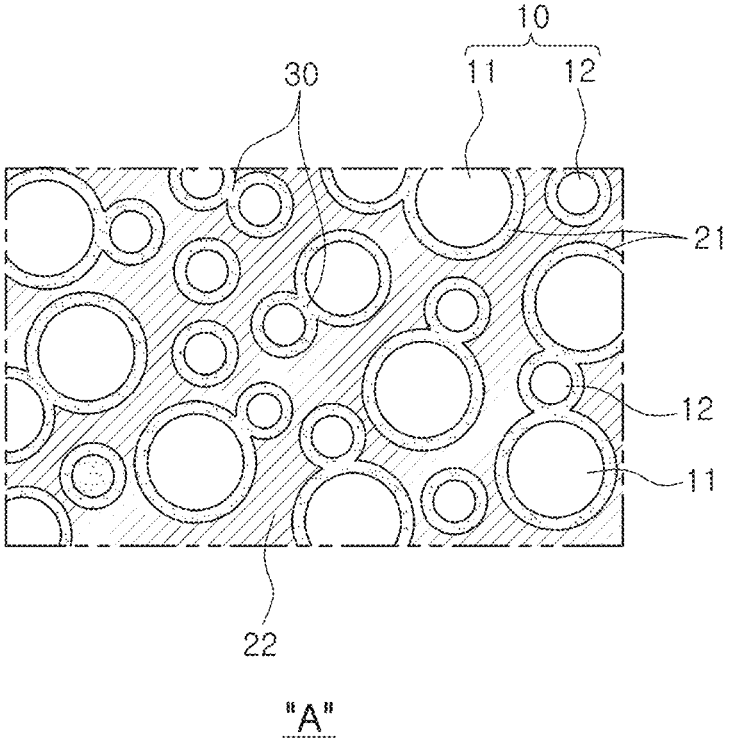
FIG. 4 is an enlarged view of another example of part A of FIG. 2.

In addition, the metal magnetic particles 10 may contain first metal magnetic particles 11 forming a coarse powder and second metal magnetic particles 12 forming a fine powder, as shown in FIG. 4. Here, the first metal magnetic particle 11 may have a particle size distribution $D_{50}$ of about 10 μm to about 20 μm, and the second metal magnetic particle 12 may have a particle size distribution $D_{50}$ of about 1 μm to about 5 μm.

In the case in which the metal magnetic particles contain the first metal magnetic particles 11 of the coarse powder and the second metal magnetic particles 12 of the fine powder, a high filling rate may be achieved, whereby permeability may be improved in a range in which eddy current loss is controlled.

The first oxide forming the oxide film 21 on the surface of the metal magnetic particle 10 and the second oxide forming the filling portion 22 filling the space between the metal magnetic particles 10 may be an oxide obtained by oxidation of at least one metal among alloy metals forming the metal magnetic particles 10.

The first oxide and the second oxide may be formed of an oxide of the same metal among alloy metals forming the metal magnetic particle 10. In the case in which the metal magnetic particle 10 is Fe—Si—Cr-based alloy, the first oxide and the second oxide may contain $Cr_2O_3$.

Meanwhile, the oxide film 21 may be recognized by a difference in contrast (brightness) in a photograph captured with a scanning electron microscope (SEM) at a magnification of 3,000 times (3,000×).

The magnetic body 110 in the embodiment may include the metal magnetic particles 10 having a high saturation magnetization value and the oxide formed between the metal magnetic particles 10 by oxidization of at least one of the alloy metals forming the metal magnetic particles 10. The oxide may be present between the adjacent metal magnetic particles 10, such that the metal magnetic particles may be isolated from each other without a necking phenomenon.

The oxide may have a gradient in which a content of at least one metal forming an oxide through oxidation of the alloy metals forming the metal magnetic particles 10 becomes reduced in a direction away from a central portion of the metal magnetic particle 10.

Here, the oxide film 21 may be formed on the surface of the metal magnetic particle 10, the oxide film 21 containing the oxide of at least one metal forming the oxide through oxidation of the alloy metals forming the metal magnetic particles 10.

The oxide film 21 formed on the surface of the metal magnetic particle 10 may form a neck portion with the oxide film formed on the surface of its adjacent metal magnetic particle.

In the embodiment, the necking phenomenon may not occur between the metal magnetic particles 10, but may occur between the oxide films 21 formed on the surfaces of the metal magnetic particles 10. Thus, eddy current loss may be reduced, and since there is no direct contact surface between the metal magnetic particles 10, a decrease in a quality factor due to an increase in AC may not be significant. Whereby in a case in which such a configuration of the metal magnetic particles 10 is applied to a power inductor, high power efficiency may be provided.

The oxide film 21 formed as the first oxide may have a thickness of about 50 nm to about 100 nm. In the case in which the thickness of the oxide film is less than about 50 nm, specific resistance of a magnetic composite body may be decreased. In the case in which the thickness thereof is greater than about 100 nm, the gap effect due to the oxide film may be excessively increased, resulting in poor magnetic properties.

In addition, the first oxide and the second oxide may occupy about 20% to about 35% of a cross-sectional area of the magnetic body 110. In the case in which the area of the oxide is excessively small as being less than about 20%, AC efficiency, DC properties and high frequency quality factor may deteriorate. In the case in which the area of the oxide is excessively large as being more than about 35%, magnetic properties may remarkably deteriorate (See Table 3).

Figure 7:
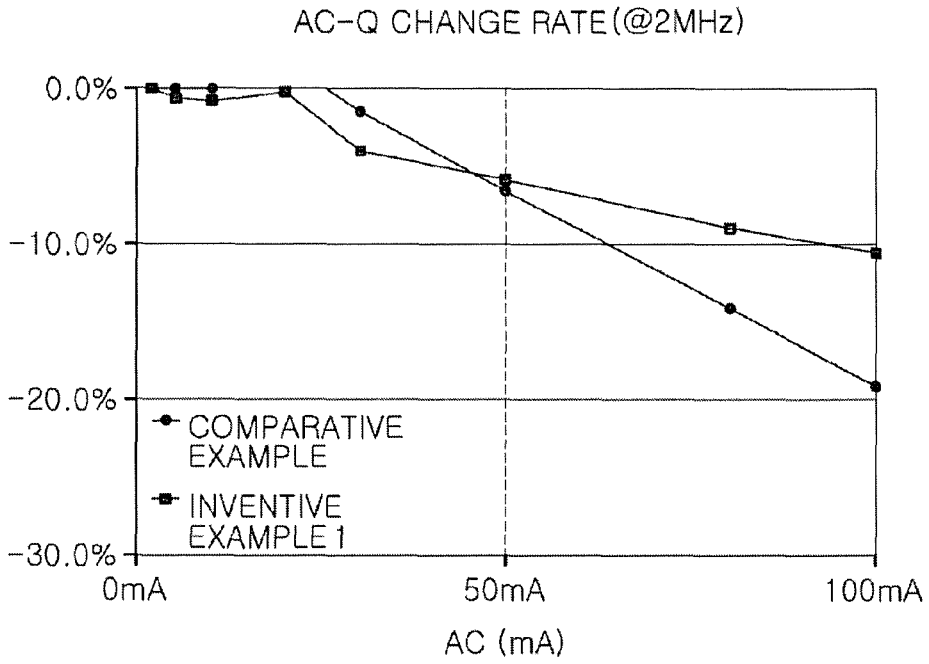
FIG. 7 is a graph showing changes in quality factors according to AC current between a multilayer inductor according to Inventive Example 1 and a multilayer inductor according to Comparative Example using ferrite as a magnetic material.

In the multilayer electronic component including the magnetic body 110 according to the embodiment, a decrease in a quality factor at AC of about 80 mA or greater may be in a range of about 10% or less (See FIG. 7).

Hereinafter, although the present disclosure will be described in detail through the following Inventive and Comparative Examples, the description thereof should not be construed as being limited to the scope of the present disclosure, but is to help a specific understanding of the present disclosure.

Inventive Example 1

A plurality of magnetic green sheets were prepared by applying a slurry obtained by mixing an alloy powder having a composition of Fe—Si—Cr (Fe 90 wt %, Si 5 wt %, Cr 5 wt %) and PVB-based organic binder, a dispersant and a plasticizer to a carrier film and performing a drying process.

Then, a copper (Cu) conductive paste was applied to the magnetic green sheets using a screen to thereby form a conductive pattern. In addition, the slurry was applied to portions of the magnetic green sheet around the conductive pattern so as to be even with the conductive pattern.

The stacked carriers having the conductive patterns were repeatedly stacked to allow the conductive patterns to be electrically connected, thereby forming a coil pattern in a stacked direction. Here, a via electrode was formed in the magnetic green sheet, such that an upper conductive pattern and a lower conductive pattern were electrically connected to each other, having the magnetic green sheet disposed therebetween.

In this case, the stacked carriers together with the upper and lower cover layers were stacked in an amount of 10 to 20 layers, and the manufactured laminate was isostatically pressed at 85° C. and 1,000 kgf/cm$^2$. The pressed laminate was cut into individual chips, and the chips were subjected to a debinding process while being maintained for 40 hours at 230° C. under air atmosphere.

Next, a sintering process was performed for 1 hour at 750° C. Here, the chip, after being sintered, was manufactured to have a size of 2.5 mm×2.0 mm (L×W).

Then, the application of a paste for external electrodes, an electrode sintering process, and a plating process, and the like were performed to form external electrodes.

The magnetic body of the manufactured multilayer inductor contained metal magnetic particles covered with oxide films made of $Cr_2O_3$, and $Cr_2O_3$ oxides present in the remaining space. Here, the necking phenomenon did not occur between the metal magnetic particles, but it only occurred between the oxide films.

Figure 5:
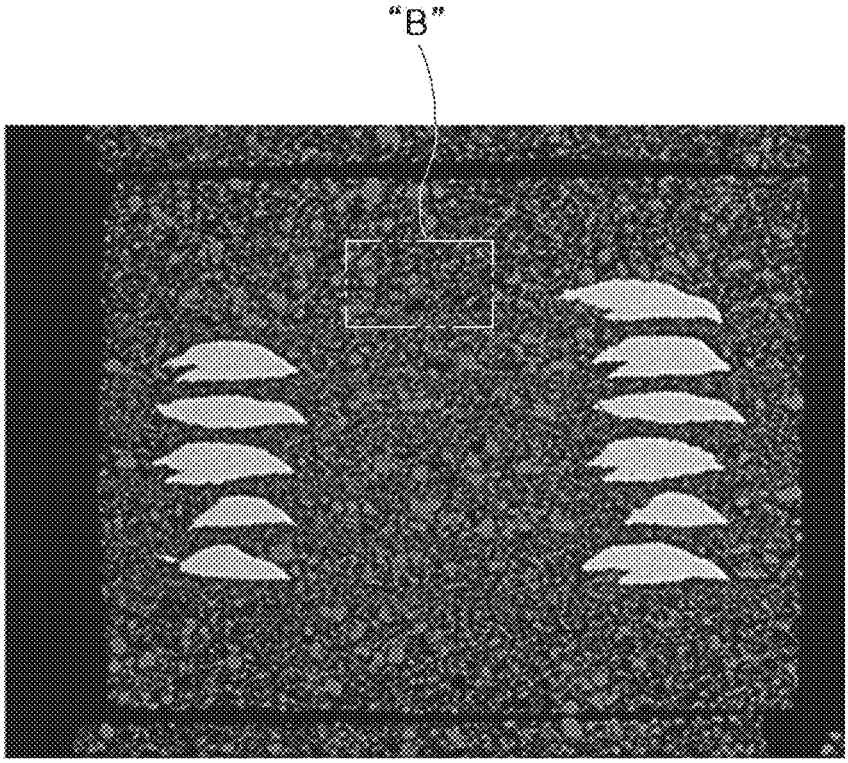
FIG. 5 is a scanning electron microscope (SEM) photograph of a cross section of a multilayer inductor in a width-thickness (W-T) direction according to an exemplary embodiment of the present disclosure.
Figure 6:
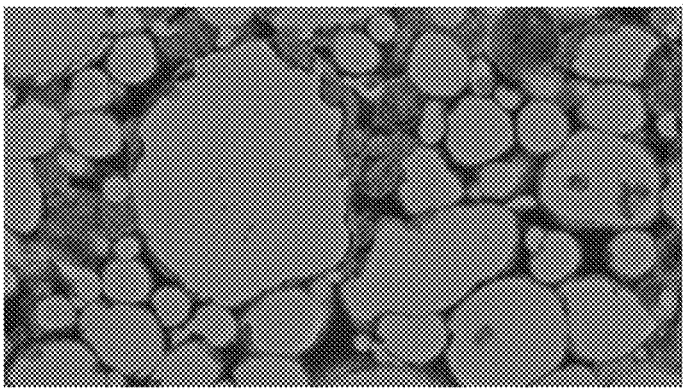
FIG. 6 is an SEM photograph of a fine structure of part B of FIG. 5.

FIG. 5 is a photograph of a cross section of the multilayer inductor in a width-thickness (W-T) direction thereof according to the embodiment captured with a scanning electron microscope (SEM) at a magnification of 200 times (200×), and FIG. 6 is a photograph of a fine structure of part A of the magnetic body captured with the SEM at a magnification of 5k times (5k×).

Inventive Examples 2 to 8

Inventive Examples 2 to 8 were the same as Inventive Example 1, except that Cr contents of Fe—Si—Cr alloys were changed as shown in the following Table 1, respectively.

The following Table 1 shows results of saturation magnetization values (Ms) obtained before and after the sintering process according to changes in Cr contents of the Fe—Si—Cr alloys of Inventive Examples 2 to 8 and Inventive Example 1.

TABLE 1

| | Cr Content (wt %) | Ms (emu/g) | Ms (emu/g) After Sintering Process |
|---|---|---|---|
| Inventive Example 2 | 3 | 188.7 | 172.4 |
| Inventive Example 3 | 3.5 | 187.6 | 174.5 |
| Inventive Example 4 | 4 | 187.4 | 176.5 |
| Inventive Example 5 | 4.5 | 185.2 | 182.1 |
| Inventive Example 1 | 5 | 184.6 | 180.3 |
| Inventive Example 6 | 5.5 | 182.1 | 176.5 |
| Inventive Example 7 | 6 | 180.3 | 170.4 |
| Inventive Example 8 | 7 | 177.9 | 165.3 |

Inventive Examples 9 to 16

Inventive Examples 9 to 16 were the same as Inventive Example 1, except that sizes of Fe—Si—Cr alloys were changed as shown in the following Table 2, respectively.

The following Table 2 shows results of permeability and quality factor according to changes in sizes of the Fe—Si—Cr alloys of Inventive Examples 9 to 16.

TABLE 2

| | Fe—Si—Cr Powder Max Size (μm) | Fe—Si—Cr Powder Size ($D_{50}$) (μm) | Permeability (μi) | Q (1 MHz, AC 2 mA) | Q (6 MHz, AC 2 mA) |
|---|---|---|---|---|---|
| Inventive Example 9 | 5 | 2 | 18.3 | 40.5 | 94.7 |
| Inventive Example 10 | 10 | 5 | 20.2 | 73 | 98.1 |

TABLE 2-continued

| | Fe—Si—Cr Powder Max Size (μm) | Fe—Si—Cr Powder Size ($D_{50}$) (μm) | Permeability (μi) | Q (1 MHz, AC 2 mA) | Q (6 MHz, AC 2 mA) |
|---|---|---|---|---|---|
| Inventive Example 11 | 20 | 10 | 25.5 | 72.2 | 43.3 |
| Inventive Example 12 | 30 | 15 | 27.2 | 65 | 35.6 |
| Inventive Example 13 | 45 | 20 | 28.3 | 61.2 | 26.4 |
| Inventive Example 14 | 50 | 30 | 33.5 | 52.3 | 23.1 |
| Inventive Example 15 | 80 | 40 | 35.5 | 44.7 | 16.7 |
| Inventive Example 16 | 100 | 45 | 37.8 | 41.5 | 13.5 |

Inventive Examples 17 to 27

Inventive Examples 17 to 27 were the same as Inventive Example 1, except that areas of oxide in the cross-section of the magnetic body were changed as shown in the following Table 3, respectively.

The following Table 3 shows results of permeability, inductance, and quality factor according to changes in area ratio of the oxide of Inventive Examples 17 to 27.

TABLE 3

| | Area Ratio (%) of Oxide | Permeability (μi) | Inductance (uH) | Q (1 MHz, AC 2 mA) | Q (1 MHz, AC 100 mA) | Q (6 MHz, AC 2 mA) | Isat (A) |
|---|---|---|---|---|---|---|---|
| Inventive Example 17 | 13.0 | 43 | 1.36 | 30 | 15.5 | 25.5 | 3.6 |
| Inventive Example 18 | 15.5 | 40 | 1.25 | 28 | 16.8 | 24.1 | 3.75 |
| Inventive Example 19 | 18.0 | 38 | 1.17 | 26.5 | 17.1 | 28.5 | 4.2 |
| Inventive Example 20 | 20.0 | 37 | 1.15 | 26.1 | 18.7 | 33.2 | 4.50 |
| Inventive Example 21 | 21.0 | 35 | 1.13 | 25.2 | 19.5 | 36 | 4.55 |
| Inventive Example 22 | 24.0 | 31 | 1.08 | 25.0 | 19.8 | 35.5 | 4.7 |
| Inventive Example 23 | 30.0 | 26 | 1.03 | 24.6 | 20.1 | 34.6 | 4.75 |
| Inventive Example 24 | 33.0 | 23 | 0.94 | 24.2 | 20.4 | 34.5 | 5 |
| Inventive Example 25 | 35.0 | 22 | 0.92 | 24.0 | 19.9 | 32.4 | 5 |
| Inventive Example 26 | 36.0 | 18 | 0.81 | 22.1 | 18.2 | 26.5 | 5 |
| Inventive Example 27 | 40.0 | 16 | 0.75 | 19.3 | 16.5 | 25.5 | 5 |

Comparative Example

Comparative Example was the same as Inventive Example 1, except that magnetic green sheets containing Ni—Zn—Cu-based powder, instead of Fe—Si—Cr alloy powder, were stacked to manufacture a multilayer inductor.

FIG. 7 shows changes in quality factors according to AC current between the multilayer inductor according to Inventive Example 1 and the multilayer inductor according to Comparative Example.

As shown in FIG. 7, a decrease in the quality factor of Inventive Example 1 was relatively small at high AC current as compared to Comparative Example. More specifically, the decrease in the quality factor at AC of 80 mA or greater was in a range of 10% or less.

Figure 8:
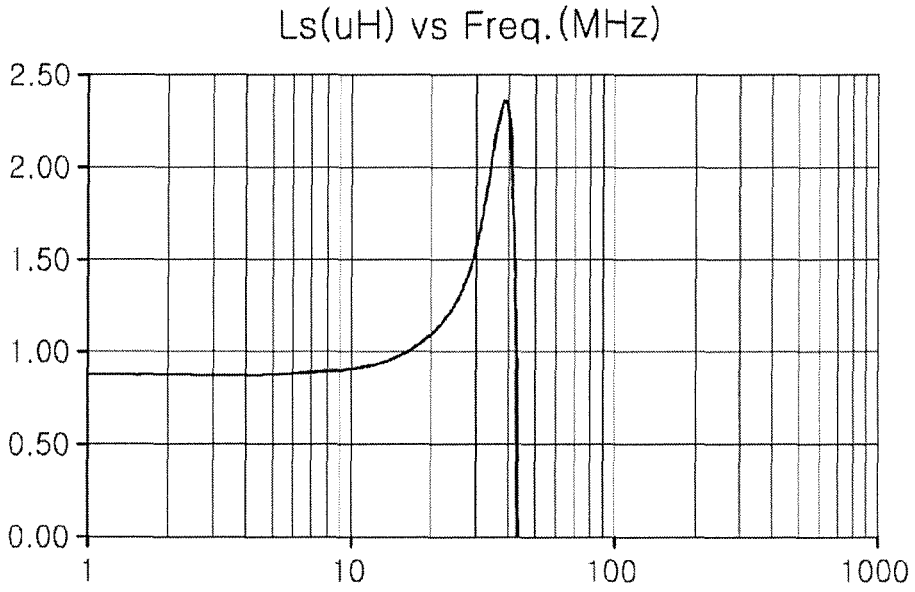
FIG. 8 is a graph showing changes in inductance values according to frequency, in a multilayer inductor (a 2520 size and 1.0 uH) according to an embodiment.
Figure 9:
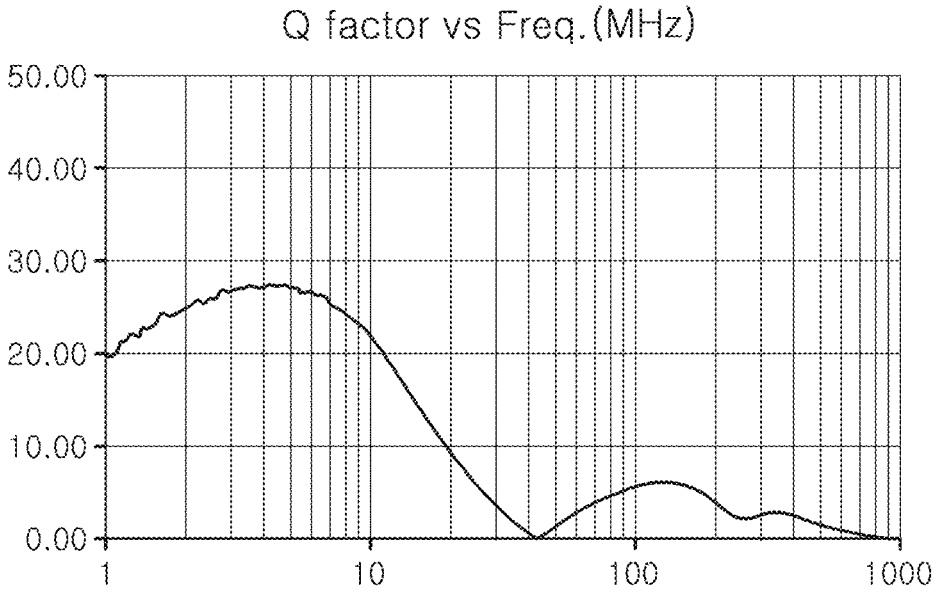
FIG. 9 is a graph showing changes in quality factors according to frequency, in a multilayer inductor (a 2520 size and 1.0 uH) according to an embodiment.

FIG. 8 is a graph showing changes in inductance values of the multilayer inductor of Inventive Example 1 according to frequency, and FIG. 9 is a graph showing changes in quality factors of the multilayer inductor of Inventive Example 1 according to frequency.

As shown in FIG. 8, when a chip was manufactured as a multilayer type chip using metal magnetic particles as in the embodiment, high inductance frequency properties were implemented in a power inductor.

As shown in FIG. 9, high frequency quality factor was excellent due to the structure in which a necking phenomenon did not occur between the metal magnetic particles in the embodiment.

Figure 10:
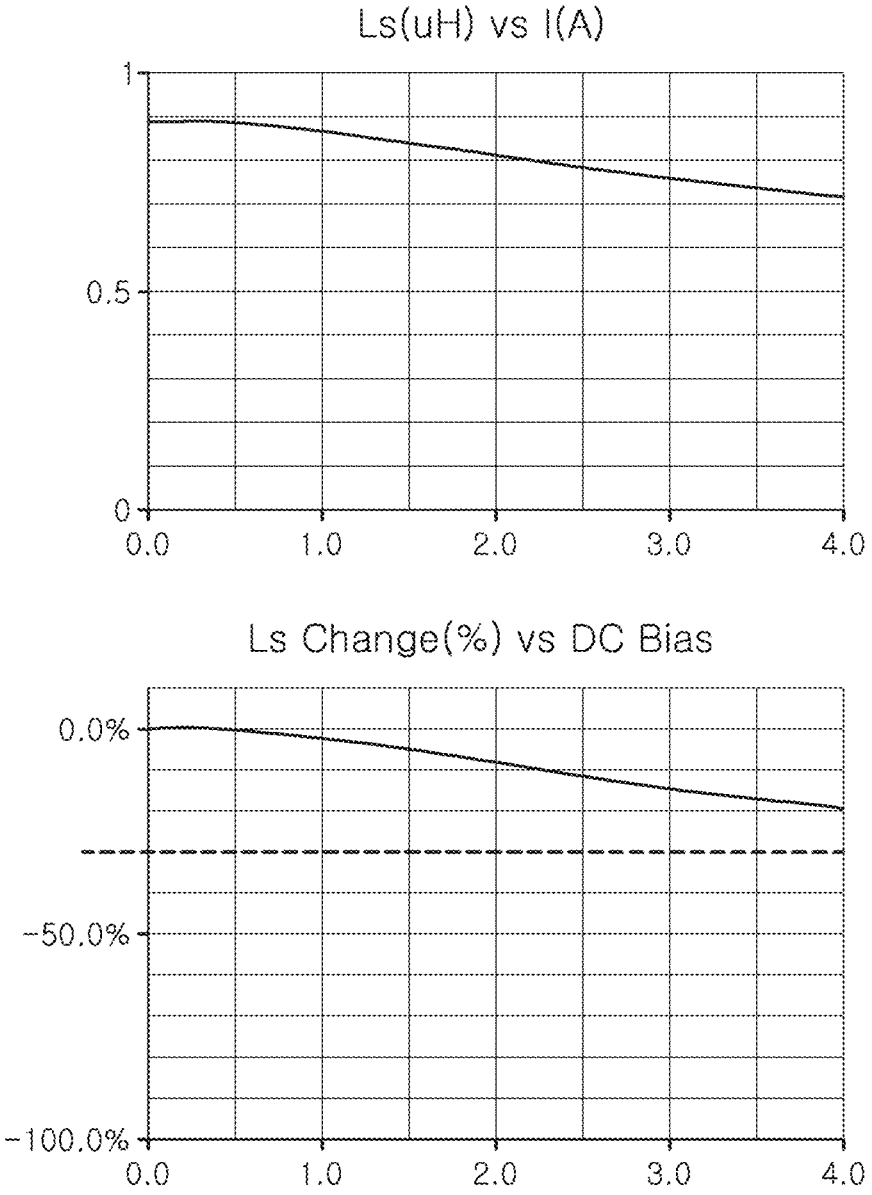
FIG. 10 is a graph showing changes in DC-bias characteristics, in a multilayer inductor (a 2520 size and 1.0 uH) according to an embodiment.

In addition, FIG. 10 is a graph showing changes in DC-bias characteristics of the multilayer inductor of Inventive Example 1. The multilayer structure using crystalline Fe—Si—Cr metal magnetic particles having a high saturation magnetization value (Ms) and effectively using inner and outer magnetic circuits was applied, such that Isat (Δ L/L:−30%) was significantly excellent as 5 A or greater.

As set forth above, according to embodiments of the present disclosure, a multilayer electronic component may be miniaturized and mass-produced, while having excellent magnetic properties, preventing deterioration in inductance resulting from the application of high current, and providing excellent DC bias characteristics.

While embodiments have been shown and described above, it will be apparent to those skilled in the art that modifications and variations could be made without departing from the spirit and scope of the present disclosure as defined by the appended claims.

What is claimed is:

1. A multilayer electronic component, comprising:

a magnetic body in which a plurality of magnetic layers are stacked; and a conductor pattern disposed in the magnetic body, wherein the magnetic body includes:

a plurality of metal magnetic particles, first oxide films around respective metal magnetic particles, and second oxide filling portions in between metal magnetic particles whose first oxide films are not in contact, wherein the first oxide films have a layer structure, including a substantially concave surface facing towards their respective metal magnetic particle and a substantially convex surface facing away from their respective metal magnetic particle, wherein the second oxide filling portions are portions that are not first oxide films and have a filling structure, including two or more substantially concave surfaces facing towards respective metal magnetic particles, wherein the first and second oxides are oxides of at least one component of the metal magnetic particle, respectively, and wherein the second oxide filling portions fill the remainder of the magnetic body not taken up by the conductor pattern, the plurality of metal magnetic particles, or the first oxide films.

2. The multilayer electronic component of claim 1, wherein the plurality of metal magnetic particles are isolated from each other.

3. The multilayer electronic component of claim 1, wherein the plurality of metal magnetic particles include an alloy containing at least one selected from a group consisting of Fe, Si, Cr, Al and Ni.

4. The multilayer electronic component of claim 1, wherein the plurality of metal magnetic particles include a Fe—Si—Cr-based alloy.

5. The multilayer electronic component of claim 4, wherein the Fe—Si—Cr-based alloy contains 87 wt % or more of Fe, 4 wt % to 6 wt % of Cr, and a remainder of Si.

6. The multilayer electronic component of claim 1, wherein the plurality of metal magnetic particles have a particle size of 45 μm or less.

7. The multilayer electronic component of claim 1, wherein the plurality of metal magnetic particles include:

first metal magnetic particles having a particle size distribution D50 of 10 μm to 20 μm, and second metal magnetic particles having a particle size distribution D50 of 1 μm to 5 μm.

8. The multilayer electronic component of claim 1, wherein the first oxide and the second oxide include the same metal.

9. The multilayer electronic component of claim 1, wherein the first oxide and the second oxide include Cr2O3.

10. The multilayer electronic component of claim 1, wherein the oxide film formed as the first oxide has a thickness of 50 nm to 100 nm.

11. The multilayer electronic component of claim 1, wherein the first and second oxides occupy 20% to 35% of a cross-sectional area of the magnetic body.

12. The multilayer electronic component of claim 1, wherein a decrease in a quality factor at an alternating current (AC) of about 80 mA or more is in a range of about 10% or less.

13. The multilayer electronic component of claim 1, wherein at least one of the first oxide and the second oxide is provided between adjacent metal magnetic particles.

14. The multilayer electronic component of claim 1, wherein the first oxide disposed on a surface of a metal magnetic particle forms a neck portion with the first oxide disposed on a surface of an adjacent metal magnetic particle.

15. A multilayer electronic component, comprising:

a magnetic body in which a plurality of magnetic layers are stacked; and a conductor pattern disposed in the magnetic body, wherein the magnetic body includes:

a plurality of metal magnetic particles, comprising:

first oxide films around respective metal magnetic particles, and second oxide filling portions in between metal magnetic particles whose first oxide films are not in contact, wherein the first oxide films have a layer structure, including a substantially concave surface facing towards their respective metal magnetic particle and a substantially convex surface facing away from their respective metal magnetic particle, wherein the second oxide filling portions are portions that are not first oxide films and have a filling structure, including two or more substantially concave surfaces facing towards respective metal magnetic particles, wherein the first oxide films has have a gradient in which a content of at least one component of the metal magnetic particle becomes reduced in a direction away from a central portion of the metal magnetic particle, and wherein the second oxide filling portions fill the remainder of the magnetic body not taken up by the conductor pattern, the plurality of metal magnetic particles, or the first oxide films.

16. The multilayer electronic component of claim 15, wherein the plurality of metal magnetic particles are isolated from each other.

17. The multilayer electronic component of claim 15, wherein the plurality of metal magnetic particles include a Fe—Si—Cr-based alloy.

18. The multilayer electronic component of claim 17, wherein the Fe—Si—Cr-based alloy contains 87 wt % or more of Fe, 4 wt % to 6 wt % of Cr, and a remainder of Si.

19. The multilayer electronic component of claim 15, wherein the plurality of metal magnetic particles have a particle size of 45 μm or less.

20. The multilayer electronic component of claim 15, wherein the oxide film includes Cr2O3.

21. The multilayer electronic component of claim 15, wherein the oxide film is formed on a surface of the metal magnetic particle, and the oxide film includes an oxide of at least one component of the metal magnetic particle.

22. The multilayer electronic component of claim 21, wherein the oxide film formed on the surface of the metal magnetic particle forms a neck portion with an oxide film of an adjacent metal magnetic particle.

23. The multilayer electronic component of claim 15, wherein the oxide occupies 20% to 35% of a cross-sectional area of the magnetic body.

24. A multilayer electronic component, comprising:

a magnetic body in which a plurality of magnetic layers are stacked; and a conductor pattern disposed on the magnetic body, wherein the magnetic body includes:

a plurality of metal magnetic particles, first oxide films around respective magnetic particles to prevent the magnetic particles from coming into contact with each other, and second oxide filling portions in between metal magnetic particles whose first oxide films are not in contact, wherein the first oxide films have a layer structure, including a substantially concave surface facing towards their respective metal magnetic particle and a substantially convex surface facing away from their respective metal magnetic particle, wherein the second oxide filling portions are portions that are not first oxide films and have a filling structure, including two or more substantially concave surfaces facing towards respective metal magnetic particles, and wherein the second oxide filling portions fill the remainder of the magnetic body not taken up by the conductor pattern, the plurality of metal magnetic particles, or the first oxide films.

25. The multilayer electronic component of claim 24, wherein an oxide film disposed on a surface of a metal magnetic particle forms a neck portion with an oxide film disposed on a surface of an adjacent metal magnetic particle.

26. The multilayer electronic component of claim 24, wherein the oxide film has a gradient in which a content of at least one component of the metal magnetic particle becomes reduced in a direction away from a central portion of the metal magnetic particle.

* * * * *